US006308599B1

(12) United States Patent
Fu-Hui

(10) Patent No.: US 6,308,599 B1
(45) Date of Patent: Oct. 30, 2001

(54) MULTI-ANGLE ADJUSTABLE SCREWDRIVER ASSEMBLY

(76) Inventor: Lin Fu-Hui, 11F-2, No. 43, Chai-I Street, Taichung City (TW)

( * ) Notice: Subject to any disclaimer, the term of this patent is extended or adjusted under 35 U.S.C. 154(b) by 0 days.

(21) Appl. No.: 09/659,069

(22) Filed: Sep. 11, 2000

(51) Int. Cl.[7] ..... B25G 1/08
(52) U.S. Cl. ..... 81/490; 81/177.8; 81/177.4
(58) Field of Search ..... 81/490, 177.8, 81/177.9, 177.2, 177.4, 177.6, 177.7, 438, 439, 440

(56) References Cited

U.S. PATENT DOCUMENTS 621,869 * 3/1899 Stynsberg ..... 81/177.8
5,421,225 * 6/1995 Chen ..... 81/490
5,802,936 * 9/1998 Liu ..... 81/490
5,927,162 * 7/1999 Huang ..... 81/490
6,053,076 * 4/2000 Barnes ..... 81/177.8

* cited by examiner

*Primary Examiner*—Eileen P. Morgan
*Assistant Examiner*—Joni B. Danganan

(57) ABSTRACT

A screwdriver assembly includes a hollow casing in which a tool body is pivotally received therein and a bit receiving member is rotatably received in the casing. A plurality of dimples defined in an inside of the casing and a boss extends from the tool body so that the boss is engaged with one of the dimples when rotating the tool body. An opening is defined in a periphery of the casing so that the tool body can be pivoted out from the casing via the opening. An access hole is defined through the casing so as to pick a bit in the bit receiving member and engaged with an engaging recess in the tool body.

3 Claims, 5 Drawing Sheets

MULTI-ANGLE ADJUSTABLE SCREWDRIVER ASSEMBLY

FIELD OF THE INVENTION

The present invention relates to a screwdriver assembly having a casing with a tool body pivotably received therein and a bit receiving member rotatably received in the casing.

BACKGROUND OF THE INVENTION

A conventional screwdriver is shown in FIG. 1 and generally includes a handle 1 with a shank 11 extending from the handle 1. A function end 111 such as a keystone tip is defined in a distal end of the shank 11 so that the function end 111 is engaged with a slot in the screw head of a bolt. The user applies a torque on the handle 1 to rotate the shank 11 and the bolt to tighten or loosen the bolt. However, because the arm of the force to generate the torque is limited so that when the bolt is tightened to a certain level, it is difficult for the user to rotate the handle 1. A hexagonal section 110 is defined in a root portion of the shank 11 and a wrench (not shown) is engaged with the hexagonal section 110 to rotate the shank 11. This is not convenience for the user to cooperate two tools to complete a job and the wrench could tool long to be operated in a narrow space.

The present invention intends to provide a screwdriver assembly which includes a tubular tool body which is pivotally received in a casing and can be set at a angle relative to the casing. A bit receiving member is rotatably received in the casing so as to conveniently provide needed bits for the tool body.

SUMMARY OF THE INVENTION

In accordance with one aspect of the present invention, there is provided a screwdriver assembly and comprising a casing having an opening defined in a periphery thereof and a first axle located at a first end in the casing and a second axle located at a second end in the casing. A tool body is pivotally mounted to the first axle and a bit receiving member is rotatably mounted to the second axle. An access hole is defined through the casing and located beside the second axle. A plurality of dimples are defined in an inside of the casing and located around the first axle.

The tool body has a passage defined through a first end thereof and an engaging recess is defined in a second end of the tool body. The first axle extends through the passage and a boss on the tool body is engaged with one of the dimples. The bit receiving member has a plurality of receiving holes defined in a side thereof for receiving bits therein and the access hole is located in alignment with one of the receiving holes in the bit receiving member.

The primary object of the present invention is to provide a screwdriver assembly wherein the tool body pivotally connected to the body can be positioned at angle relative to the casing.

Another object of the present invention is to provide a screwdriver assembly which has a compact size for convenience of carry.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
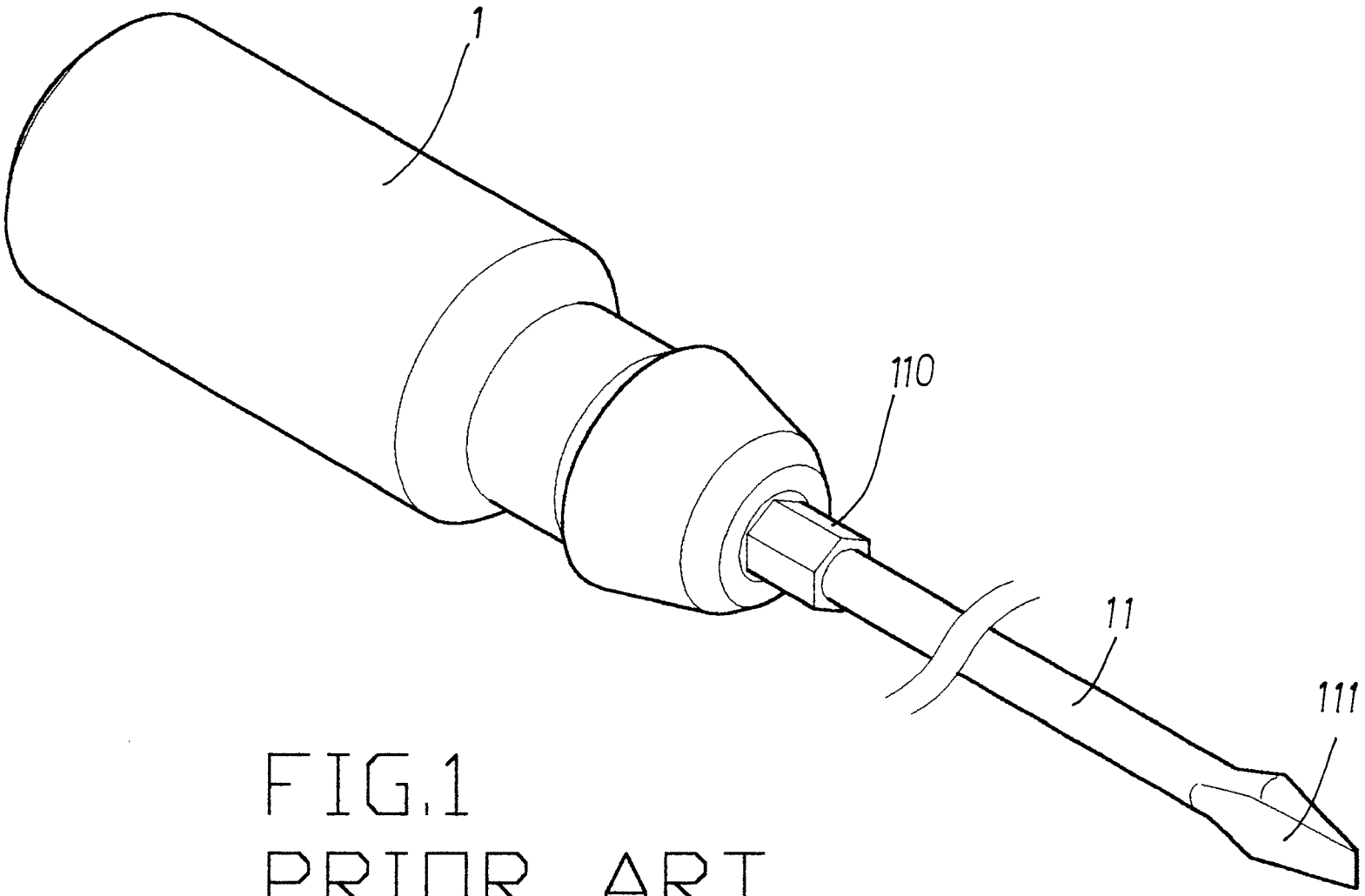
FIG.1 PRIOR ART
FIG. 1 is a perspective view to show a conventional screwdriver.
Figure 2:
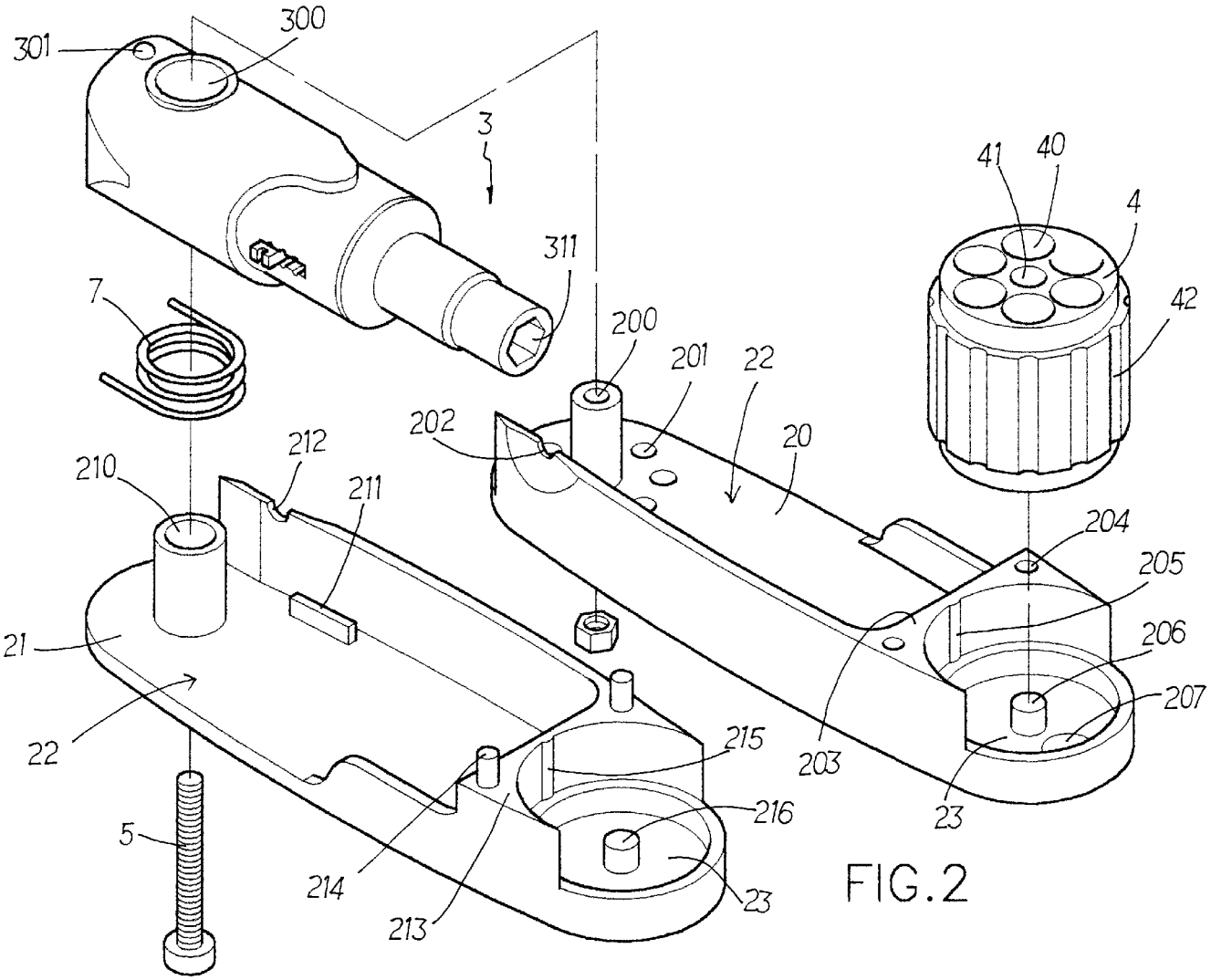
FIG. 2 is an exploded view to show a screwdriver assembly of the present invention.
Figure 3:
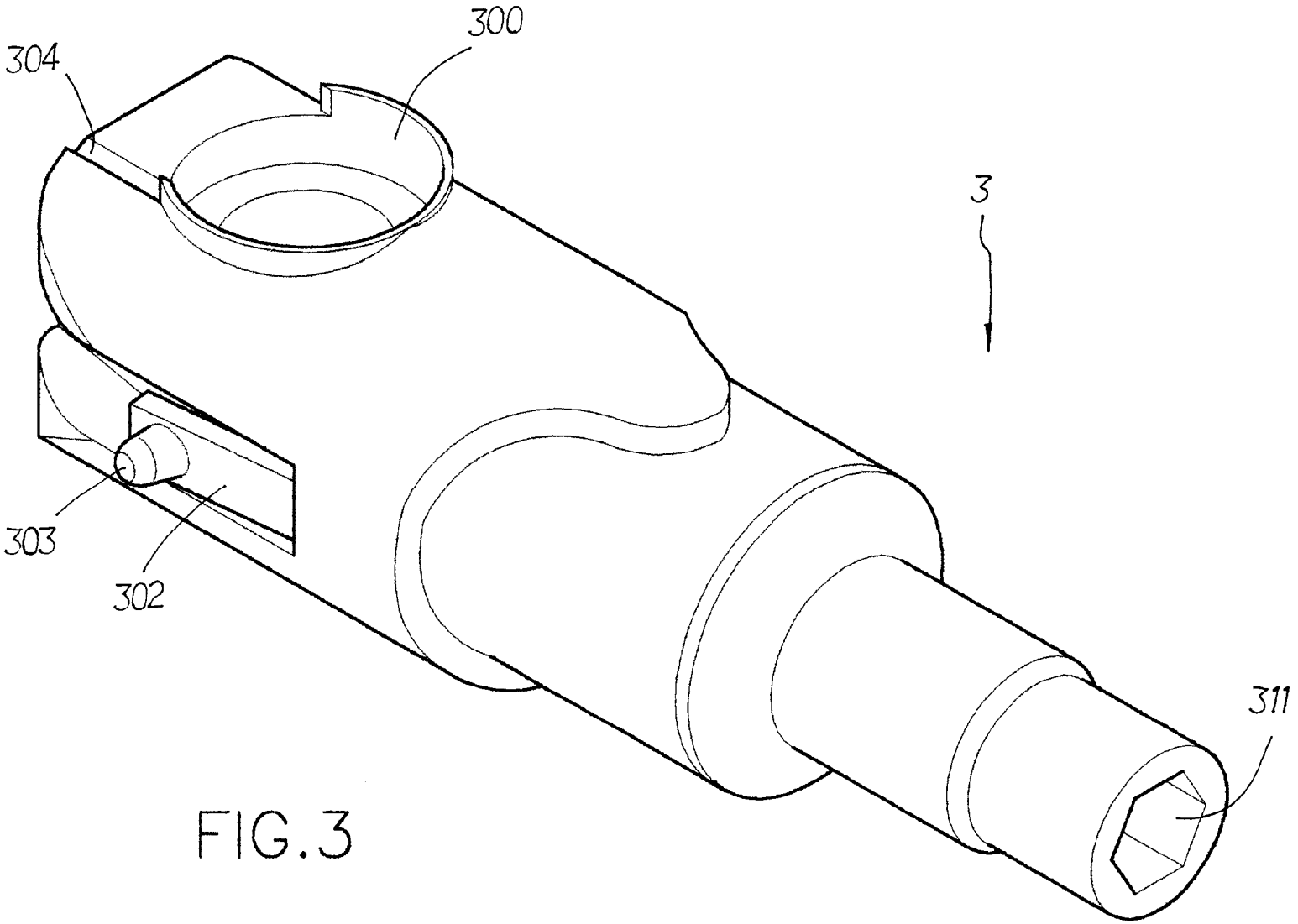
FIG. 3 is a perspective view to show a tool body of the present invention.
Figure 4:
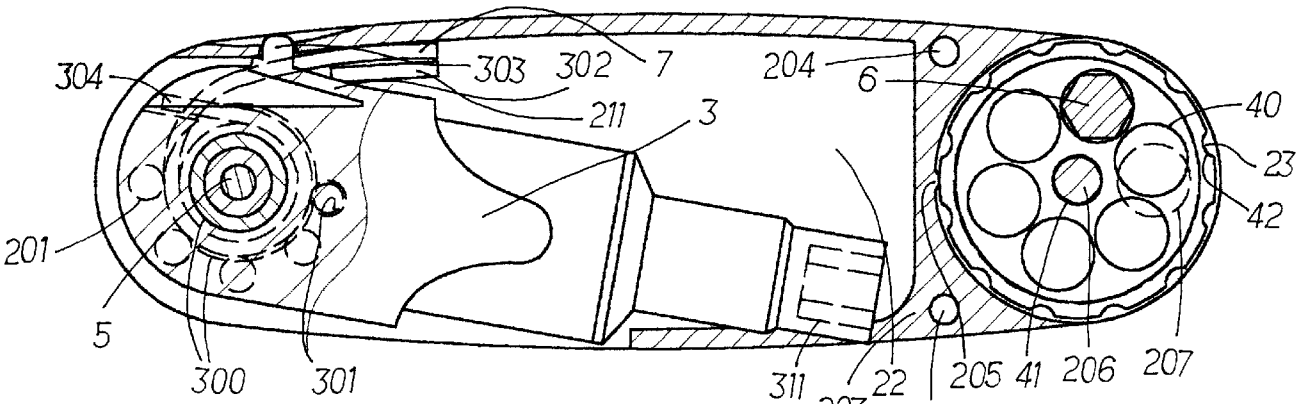
FIG. 4 is a cross sectional view to show the tool body and the bit receiving member are respectively received in the casing of the present invention.

Referring to FIGS. 2 to 4, the screwdriver assembly of the present invention comprises a casing 2 which is composed of a first part 20 and a second part 21. The first part 20 has a first tube 200 extending from a first end thereof and a first separating wall 203 extends from a second end of the first part 20 so as to define two partitions 22, 23 in the first part 20. A semi-circular recess 202 is defined in a flange of the first part 20 and close to the first tube 200. An opening is defined in a periphery of the first part 20 and the first tube is located between the semi-circular recess 202 and the opening. Two holes 204 are defined in the first separating wall 203 and a first rod 206 extends from the inside of the first part 20 in the partition 23. An access hole 207 is defined through the first part 20 in the partition 23 and located beside the first rod 206.

The second part 21 has a second tube 210 extending from a first end thereof and a second separating wall 213 extends from a second end of the second part 21 so as to defined two partitions 22, 23 in the second part 21. A semi-circular recess 212 is defined in a flange of the second part 21 and close to the second tube 210. An opening is defined in a periphery of the second part 20 and the second tube 210 is located between the semi-circular recess 212 and the opening. A plate 211 is located in the inside of the second part 21. Two protrusions 214 extend from the second separating wall 213 and a second rod 216 extends from the inside of the partition 23.

The first part 20 and the second part 22 are combined by a bolt 5 extending through the second tube 210 and the first tube 200. The combination of the first tube 200 and the second tube 210 forms a first axle. The two protrusions 214 are engaged with the two holes 204, and the first rod 206 and the second rod 216 are connected to be a second axle. The two semicircular recesses 202, 212 are cooperated to define a button hole 24. A plurality of dimples 201 are defined in the inside of the first part 20 and located around the first axle.

A tool body 3 has a passage 300 defined through a first end thereof and an engaging recess 311 defined in a second end of the tool body 3. The first axle extends through the passage 300 and a boss 301 extends from the tool body 3. A flexible member 302 extends from the tool body 3 and a button 303 extends from the flexible member 302 wherein the button 303 is received in the button hole 24 of the casing 2. A slit 304 is defined in the tool body 3 as shown in FIG. 4. The tool body 3 is pivotally received in the casing 2 and a torsion spring 7 is mounted to the first axle and received in the passage 200 of the tool body 3. One end of the torsion spring 7 is engaged with the plate 211 and the other end of the torsion spring 7 is engaged with the slit 304 in the tool body 3. Therefore, the tool body 3 is rotatable about the first axle with the boss 301 engaged with one of the dimples 201.

Figures 6, 7:
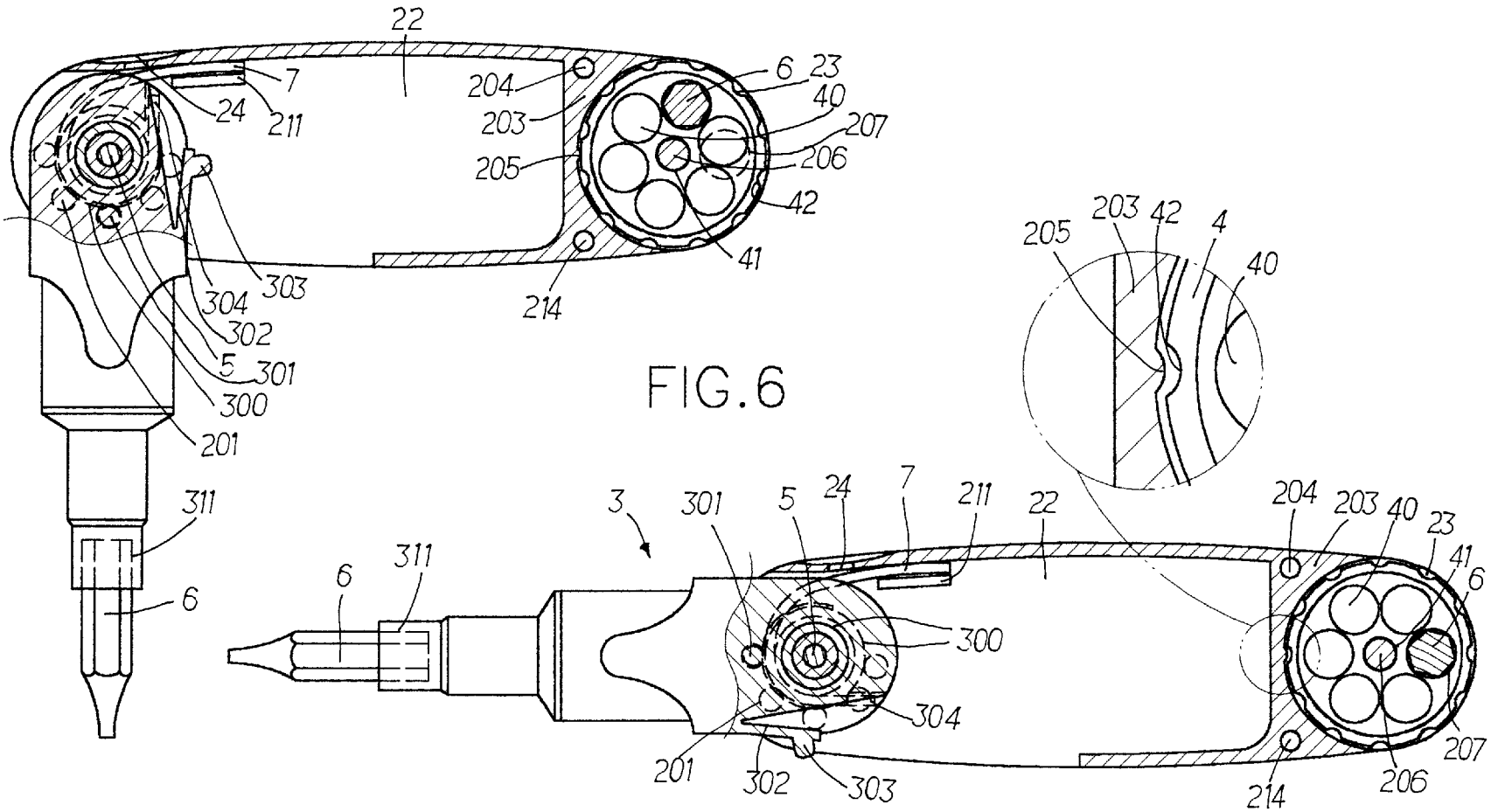
FIG. 6 is a cross sectional view to show the tool body is pivoted and an angle of 90 degrees is defined between the tool body and the casing of the present invention.
FIG. 7 is a cross sectional view to show the tool body is pivoted and an angle of 180 degrees is defined between the tool body and the casing of the present invention.

A bit receiving member 4 has a hole 41 for mounting on the second axle composed of the first rod 206 and the second rod 216. A plurality of receiving holes 40 are defined in a side of the bit receiving member 4 and each receiving hole 40 receives a bit 6. The access hole 207 is located in alignment with one of the receiving holes 40 in the bit receiving member 4 so that the user may easily pick the desired bit 6 by rotating the bit receiving member 4 and picking the bit 6 via the access hole 207. Two ridges 205, 215 respectively extend from the first separating wall 203 and the second separating wall 213, the two ridges 205, 215 are located in alignment with each other. The bit receiving member 4 has a plurality of grooves 42 defined in an outer periphery thereof so that the ridge 205/215 is engaged with one of the grooves 42 in the bit receiving member 4 to position the bit receiving member 4 as shown in FIG. 7.

Figure 5:
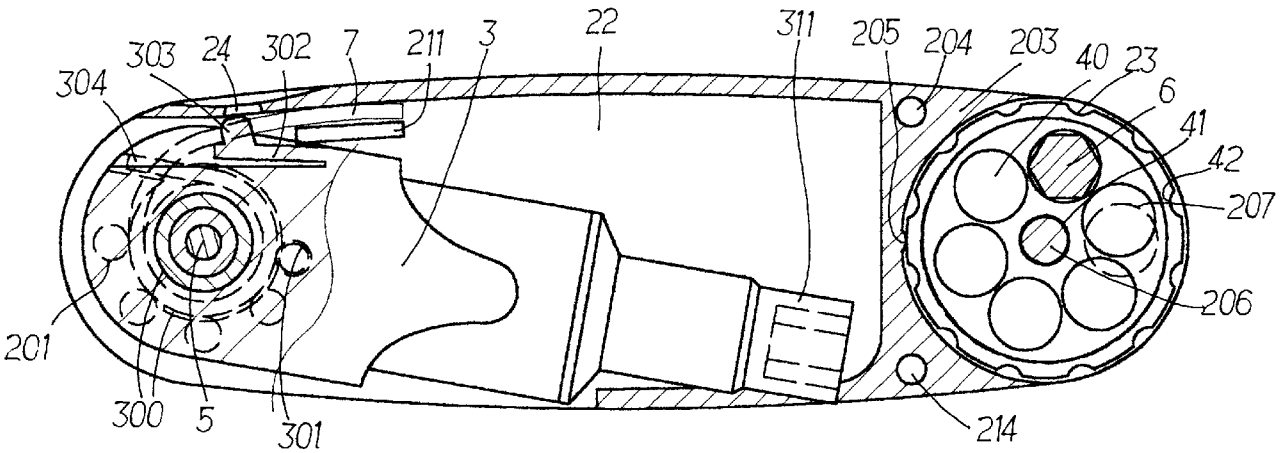
FIG. 5 is a cross sectional view to show a button is pushed to allow the tool body be pivotable.

When using the tool body 3, as shown in FIG. 5, the button 303 is pushed into the button hole 24 and the tool body 3 is rotated about the first axle by the torsion spring 7 so that the tool body 3 is pivoted from the opening of the casing 2. The angle between the tool body 3 and the casing 2 can be adjusted by rotating the tool body 3 with the boss 301 engaged with one of the dimples 201. Therefore, the user can adjust the angle of the tool body 3. The tool body 3 can be received in the casing 2 so as to have a compact screwdriver assembly.

While we have shown and described various embodiments in accordance with the present invention, it should be clear to those skilled in the art that further embodiments may be made without departing from the scope and spirit of the present invention.

What is claimed is:

1. A screwdriver assembly comprising:

a casing having an opening defined in a periphery thereof and a first axle located at a first end in said casing and a second axle located at a second end in said casing, an access hole defined through said casing and located beside said second axle;

a plurality of dimples defined in an inside of said casing and located around said first axle;

a tool body having a passage defined through a first end thereof and an engaging recess defined in a second end of said tool body, said first axle extending through said passage and a boss extending from said tool body, said tool body pivotally received in said casing and being rotatable about said first axle with said boss engaged with one of said dimples, and a bit receiving member having a plurality of receiving holes defined in a side thereof and said bit receiving member rotatably mounted to said second axle, said access hole located in alignment with one of said receiving holes in said bit receiving member.

2. The screwdriver assembly as claimed in claim 1, wherein a flexible member extends from said tool body and a button extends from said flexible member, a button hole defined through said periphery of said casing and said button received in said button hole, a plate located in said inside of said casing and said tool body having a slit defined therein, a torsion spring mounted to said first axle and received in said passage of said tool body, one end of said torsion spring engaged with said plate and the other end of said torsion spring engaged with said slit in said tool body.

3. The screwdriver assembly as claimed in claim 1 further comprising a separating wall located in said casing and a ridge extending from said separating wall, said bit receiving member having a plurality of grooves defined in an outer periphery thereof so that said ridge is engaged with one of said grooves in said bit receiving member.

* * * * *